US008911255B2

(12) United States Patent
Scherer et al.

(10) Patent No.: US 8,911,255 B2
(45) Date of Patent: Dec. 16, 2014

(54) ELECTRICAL CONNECTOR ASSEMBLY AND SYSTEM

(75) Inventors: Richard J. Scherer, Austin, TX (US); Joseph N. Castiglione, Cedar Park, TX (US); Abhay R. Joshi, Austin, TX (US); Jesse A. Mann, Cedar Park, TX (US); Adam P. Rumsey, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 101 days.

(21) Appl. No.: 13/825,337

(22) PCT Filed: Jan. 31, 2011

(86) PCT No.: PCT/US2011/023088

§ 371 (c)(1),
(2), (4) Date: Mar. 21, 2013

(87) PCT Pub. No.: WO2012/050628

PCT Pub. Date: Apr. 19, 2012

(65) Prior Publication Data

US 2013/0196555 A1 Aug. 1, 2013

Related U.S. Application Data

(60) Provisional application No. 61/392,623, filed on Oct. 13, 2010.

(51) Int. Cl.

| | |
|---|---|
| ***H01R 13/648*** | (2006.01) |
| ***H01R 13/6463*** | (2011.01) |
| ***H01R 24/00*** | (2011.01) |
| ***H01R 13/6587*** | (2011.01) |
| *H01R 13/518* | (2006.01) |

(52) U.S. Cl.

CPC ..... *H01R 23/10* (2013.01); *H01R 13/6463* (2013.01); *H01R 13/518* (2013.01); *H01R 13/6587* (2013.01)

USPC ..... 439/607.07

(58) Field of Classification Search

USPC ..... 439/607.06–607.11, 701

See application file for complete search history.

(56) References Cited

U.S. PATENT DOCUMENTS 4,556,275 A 12/1985 Hamsher
5,184,965 A 2/1993 Myschik (Continued)

FOREIGN PATENT DOCUMENTS

WO WO 2011-094656 8/2011

OTHER PUBLICATIONS

International Search Report for PCT International Application No. PCT/US2011/023088, mailed on Nov. 23, 2011, 3 pages.

*Primary Examiner* — Gary Paumen
(74) *Attorney, Agent, or Firm* — Robert S. Moshrefzadeh

(57) ABSTRACT

An electrical connector system includes a header and an electrical connector assembly. The header includes a leading end having a plurality of contact pins that are insertable into an electronic device and a plurality of separated stripline ground plates extending from the leading end toward a mating end of the header. The electrical connector assembly is coupleable with the mating end of the header and includes a plurality of electrical connectors secured in a stacked configuration. Each electrical connector includes a planar insulative connector body and a plurality of electrical cable terminations for mating with a corresponding plurality of contact pins of the header. At least two electrical cable terminations make electrical contact with a common stripline ground plate when the header and the electrical connector assembly are in a mated configuration.

10 Claims, 8 Drawing Sheets

(56) References Cited

U.S. PATENT DOCUMENTS

| | | | | |
|---|---|---|---|---|
| 5,387,124 | A | 2/1995 | Shinohara | |
| 5,425,657 | A | 6/1995 | Davis | |
| 5,993,268 | A | 11/1999 | Yamaguchi | |
| 6,524,135 | B1 | 2/2003 | Feldman | |
| 7,422,490 | B2 | 9/2008 | Droesbeke | |
| 7,621,779 | B2 * | 11/2009 | Laurx et al. | 439/607.07 |
| 7,744,414 | B2 | 6/2010 | Scherer | |
| 7,841,900 | B2 * | 11/2010 | Liu et al. | 439/607.07 |
| 2002/0048995 | A1 * | 4/2002 | Shindo | 439/608 |
| 2003/0040203 | A1 | 2/2003 | Kuroda | |
| 2004/0043661 | A1 * | 3/2004 | Okada et al. | 439/608 |
| 2005/0032430 | A1 * | 2/2005 | Otsu et al. | 439/608 |
| 2010/0035470 | A1 | 2/2010 | Liu | |
| 2013/0102192 | A1 * | 4/2013 | Davis | 439/607.07 |

* cited by examiner

ELECTRICAL CONNECTOR ASSEMBLY AND SYSTEM

TECHNICAL FIELD

The present disclosure relates generally to interconnections made between a printed circuit board and one or more electrical cables carrying signals to and from the printed circuit board. More particularly, the present disclosure relates to an assembly of electrical connectors for electrical cables and system to facilitate these interconnections.

BACKGROUND

A variety of connectors for terminating electrical cables are known in the art. Such connectors are typically designed for a single type of application and are not typically easily altered for use with, for example, different signal/ground configurations, or for use with different types of connection methods, such as, for example, soldering or welding. In addition, known connectors are typically difficult to assemble, often requiring multiple molding steps, over-molding of electrical contacts and the like, which adds time and expense to the connector fabrication process. Finally, known connectors often do not provide adequate performance characteristics for high performance systems. Inadequate performance characteristics include, for example, the inability to control the impedance within the connector, or to match the connector impedance with that of the system in which the connector is used. It is desirable to provide connectors that provide greater flexibility in its use, that is easy and economical to produce, and that can be used in electrical connector assemblies that mate with headers in a manner that minimizes crosstalk between signal paths and provides controlled electrical impedance for each signal path. It is further desirable to provide electrical connector assemblies and systems having high circuit switching speeds, increased signal line densities with controlled electrical characteristics, and improved/controlled signal integrity suited to meet the evolving demands of end-users.

SUMMARY

In one aspect, the present invention provides an electrical connector system including a header and an electrical connector assembly. The header includes a leading end having a plurality of contact pins that are insertable into an electronic device and a plurality of separated stripline ground plates extending from the leading end toward a mating end of the header. The electrical connector assembly is coupleable with the mating end of the header and includes a plurality of electrical connectors secured in a stacked configuration. Each electrical connector includes a planar insulative connector body and a plurality of electrical cable terminations for mating with a corresponding plurality of contact pins of the header. Each electrical cable termination includes a tubular housing of electrically conductive material having inner walls defining an opening and first and second opposed open ends; an inner housing of electrically insulating material inserted into the tubular housing from at least one of the open ends thereof, the inner housing comprising at least one inner space configured to receive an electrical contact in a fixed relative position; and at least one electrical contact positioned in the inner housing and configured to be connected to an electrical cable. The planar insulative connector body has an upper surface and an opposing lower surface. The upper and lower surfaces are defined by a front edge, a back edge, and two longitudinal side edges. The upper surface includes a plurality of longitudinal channels. Each channel contains one of the plurality of electrical cable terminations. The front edge of the connector body has a plurality of openings for guiding the contact pins into the mating electrical cable terminations positioned within the channels. At least two electrical cable terminations make electrical contact with a common stripline ground plate when the header and the electrical connector assembly are in a mated configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Embodiments provide an electrical connector assembly that couples with a stripline header to commonly ground at least two electrical cable terminations within the electrical connector system. In one embodiment, at least one electrical cable termination commonly grounds adjacent stripline ground plates within the stripline header. The electrical connector assembly includes multiple electrical cable terminations, where each electrical cable termination includes a cable terminated to at least one contact that is configured to electrically couple with a contact pin provided by the header. Each electrical cable termination includes a tubular housing that is configured to contact at least one of the stripline ground plates within the header. In one embodiment, the tubular housings of the carrier assembly are configured to commonly ground all of the stripline ground plates in the header.

Figure 1A:
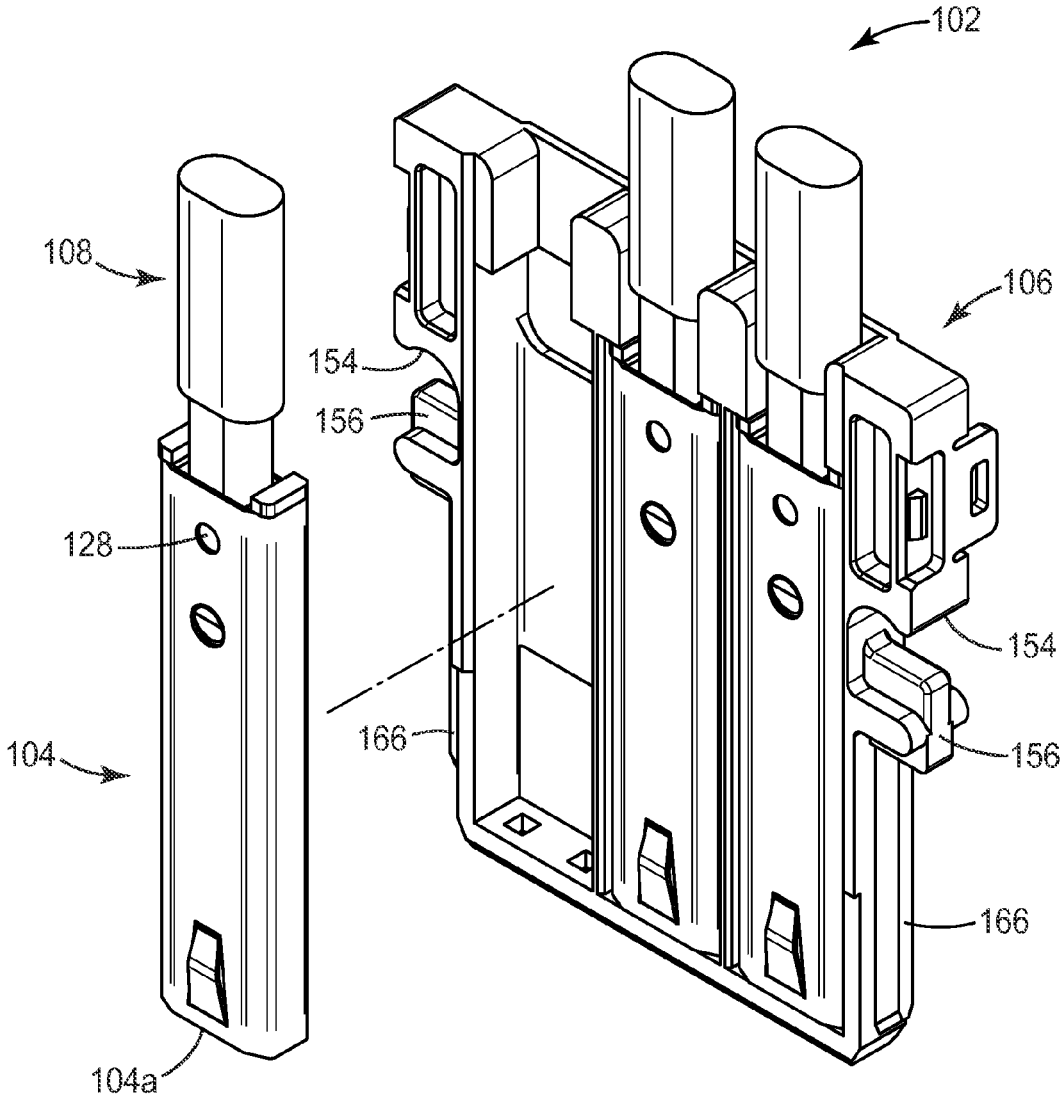
FIG. 1*a* is a perspective view of an exemplary embodiment of an electrical connector according to an aspect of the present invention in a partially assembled configuration.
Figure 1B:
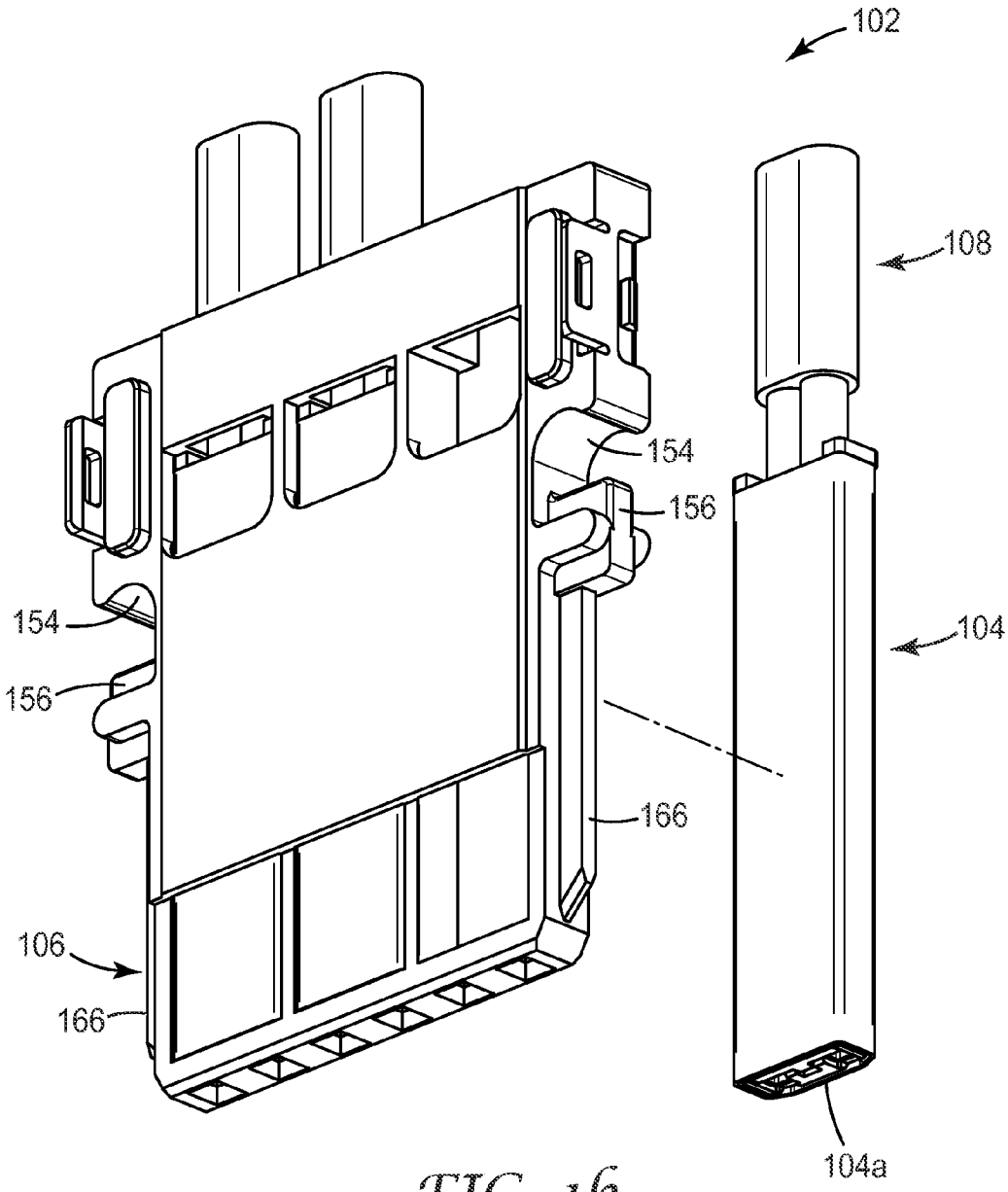
FIG. 1*b* is another perspective view of the electrical connector of FIG. 1*a* in a partially assembled configuration.
Figure 1C:
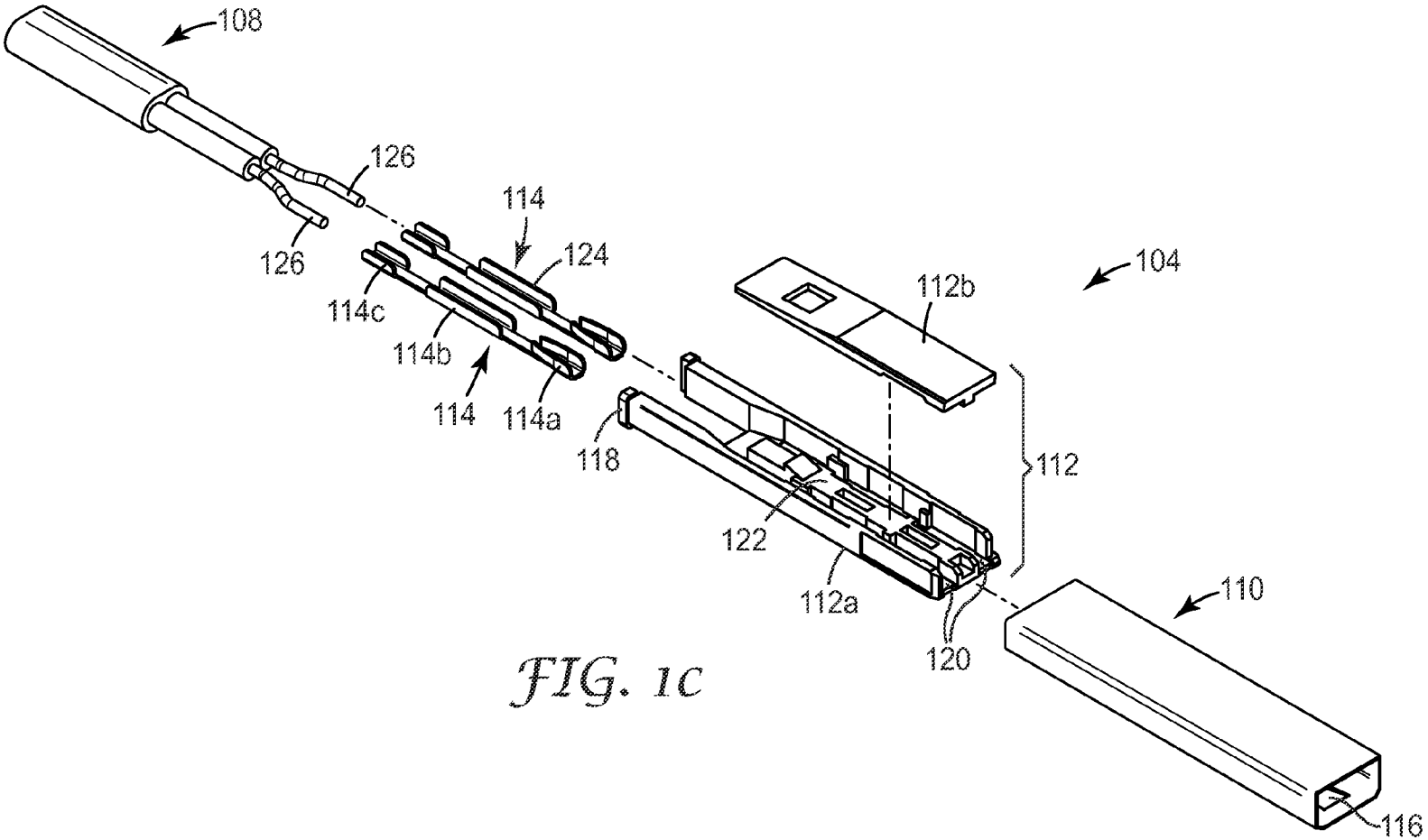
FIG. 1*c* is an exploded perspective view of an electrical cable termination of the electrical connector of FIG. 1*a*.
Figure 1D:
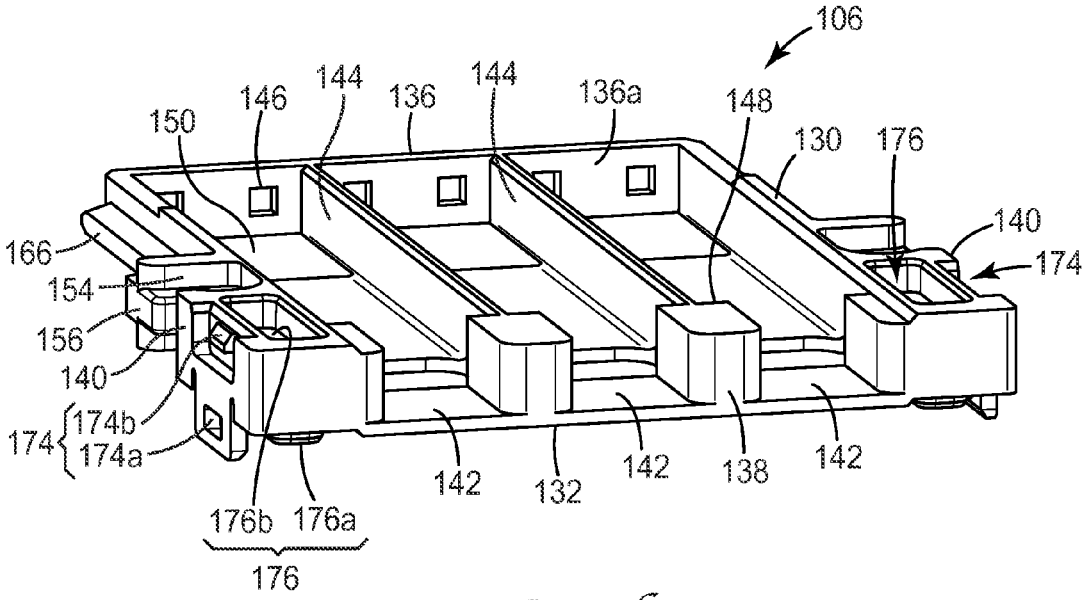
FIG. 1*d* is a perspective view of a planar insulative connector body of the electrical connector of FIG. 1*a*.

Referring now to the Figures, FIGS. 1*a*-1*d* illustrate an exemplary embodiment of an electrical connector according to an aspect of the present invention in a partially assembled configuration (FIGS. 1*a*-1*b*) and its components (FIGS. 1*c*-1*d*). Electrical connector 102 includes three electrical cable terminations 104 and a planar insulative connector body 106. Electrical cable terminations 104 are configured for mating with a corresponding plurality of contact pins, such as, e.g., contact pins 264 of header 200 illustrated in FIG. 3. Electrical cable terminations that can be used in conjunction with connector body 106 can be constructed substantially similar to the shielded controlled impedance (SCI) connectors described in U.S. Pat. No. 5,184,965, incorporated by reference herein.

Each electrical cable termination 104 is connected to an electrical cable 108. As best seen in FIG. 1*c*, each electrical cable termination 104 includes a tubular housing 110, an inner housing 112, and electrical contacts 114. Tubular housing 110 is made from an electrically conductive material and has inner walls defining an opening and first and second opposed open ends. Optionally, it has one or more external ground contacts 116 configured to make electrical contact, e.g., with a corresponding contact pin, a corresponding ground blade, or an adjacent electrical cable termination Inner housing 112 is made from an electrically insulating material and can be a single part housing (not shown) or a multiple part housing. FIG. 1*c* illustrates an example of a multiple part housing including inner housing part 112*a* and inner housing part 112*b*. In assembly, inner housing part 112*a* and inner housing part 112*b* are kept in relative position by tubular housing 110 in combination with positioning features on the inner housing parts Inner housing part 112*a* includes stop 118 configured to assist in properly positioning inner housing 112 in tubular housing 110. In addition, it includes inner spaces 120 configured to receive electrical contacts 114, separated by an inner housing center wall 122. Electrical contacts 114 are conventional in design. They are formed of sheet material into a generally u-shaped form and include front passage-shaped plug-in portion 114*a*, contact positioning portion 114*b*, and rear connection portion 114*c*. Front passage-shaped plug-in portion 114*a* is configured to be separably electrically connected to a corresponding contact pin, such as, e.g., contact pin 264 of header 200 illustrated in FIG. 3. Contact positioning portion 114*b* includes a contact positioning feature 124 on each side of the contact configured to position the contact in inner housing 112. Rear connection portion 114*c* is configured to be electrically connected to conductor 126 of electrical cable 108. Electrical cable 108 is attached to electrical cable termination 104 through the use of a solder opening such as opening 128 shown in FIG. 1*a*. The type of electrical cable used in this exemplary embodiment present in the current art can be a single wire cable (e.g. single coaxial or single twinaxial) or a multiple wire cable (e.g. multiple coaxial or multiple twinaxial or twisted pair cables).

Figure 3:
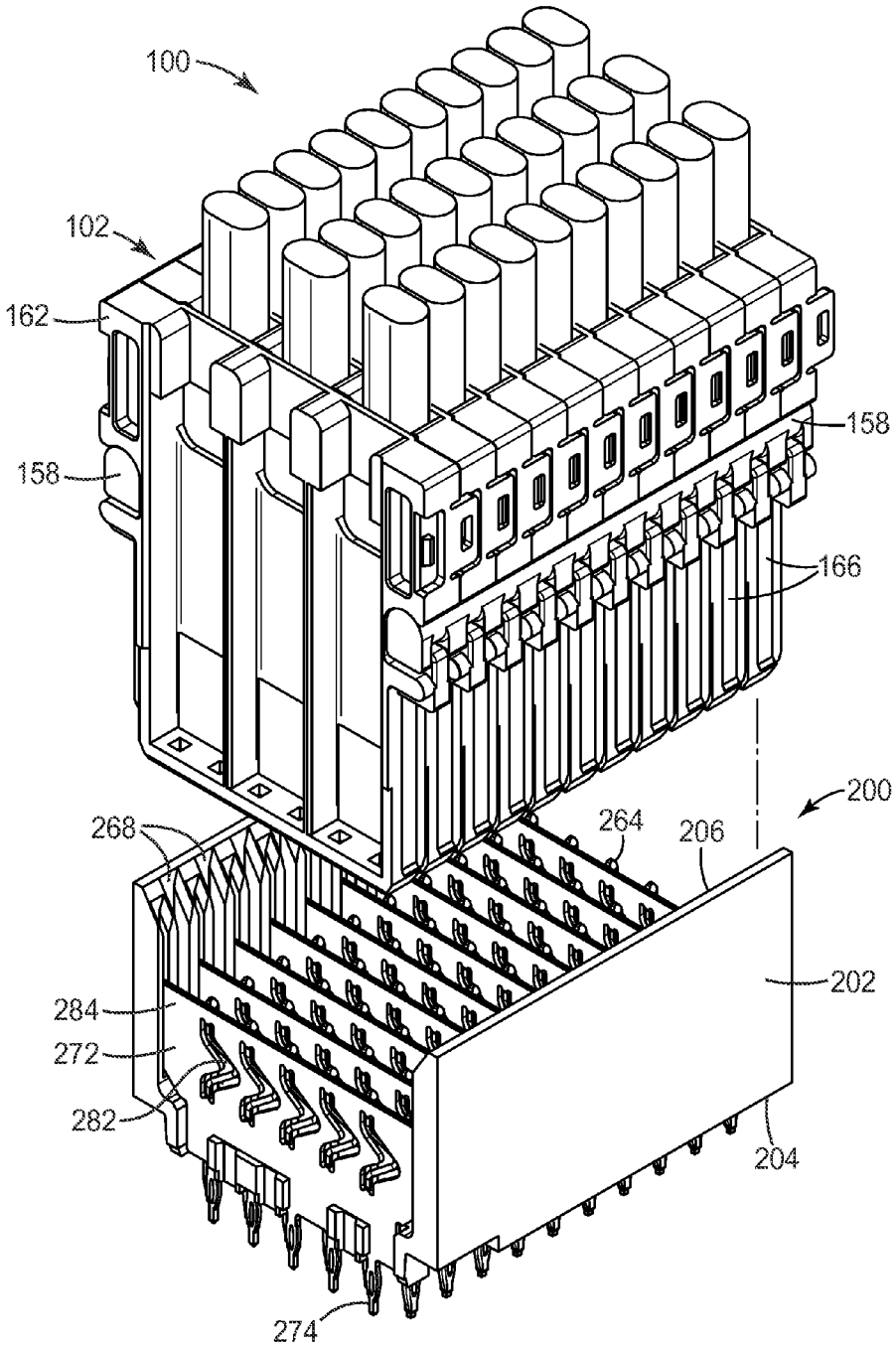
FIG. 3 is a perspective view of the connector assembly of FIG. 2 aligned for mating with a corresponding header.

In one aspect of the present invention, at least one of the electrical cable terminations 104 includes at least one external ground contact extending from tubular housing 110 and configured to make electrical contact with a corresponding stripline ground plate, such as, e.g., stripline ground plate 272 of header 200 illustrated in FIG. 3. In the exemplary embodiment of FIGS. 1*a*-1*d*, one external ground contact 116 extends from tubular housing 110. External ground contact 116 extends toward an adjacent electrical connector 102 (when a plurality of electrical connectors 102 are secured in a stacked configuration), and is configured to make electrical contact with a corresponding stripline ground plate, such as, e.g., stripline ground plate 272 of header 200 illustrated in FIG. 3. The electrical connections involving external ground contacts 116 will be described in more detail below. In the illustrated embodiments, external ground contacts 116 include resilient beams extending from tubular housing 110. In other embodiments, external ground contacts 116 may take alternate forms from those illustrated, and may include, for example, a Hertzian bump extending from tubular housing 110.

Referring to FIG. 1*d*, planar insulative connector body 106 includes an upper surface 130 and an opposing lower surface 132. The upper and lower surfaces 130, 132 are defined by a front edge 136, a back edge 138, and two longitudinal side edges 140. Upper surface 130 of connector body 106 includes a plurality of longitudinal channels 142 separated by ribs 144 extending from openings 146 in front edge 136 toward back edge 138. Each channel 142 is adapted to receive electrical cable termination 104 and retain it securely within connector body 106. Electrical cable terminations 104 are inserted into channels 142 such that the front face 104*a* of electrical cable terminations 104 abuts interior surface 136*a* of front edge 136. Openings 146 in front edge 136 are configured to guide a corresponding plurality of contact pins, such as, e.g., contact pins 264 of header 200 illustrated in FIG. 3, into electrical cable terminations 104 positioned within channels 142. Each channel 142 includes a stop 148 configured to assist in retaining electrical cable termination 104 in connector body 106. Electrical cable terminations 104 may be retained within connector body 106 by any suitable method, such as, e.g., snap fit, friction fit, press fit, and mechanical clamping. The method used to retain electrical cable terminations 104 within connector body 106 may permit electrical cable terminations to be removed, individually or in sets, or the method used to retain electrical cable terminations 104 within connector body 106 may permanently secure electrical cable terminations 104 within connector body 106. The ability to remove and replace individual electrical cable terminations 104 is beneficial when replacing a damaged or defective electrical cable termination 104 or electrical cable 108, for example. To accommodate electrical contact of external ground contact 116 of electrical cable termination 104 with a corresponding stripline ground plate, such as, e.g., stripline ground plate 272 of header 200 illustrated in FIG. 3, connector body 106 may include an opening 150 disposed in lower surface 132.

Figure 2:
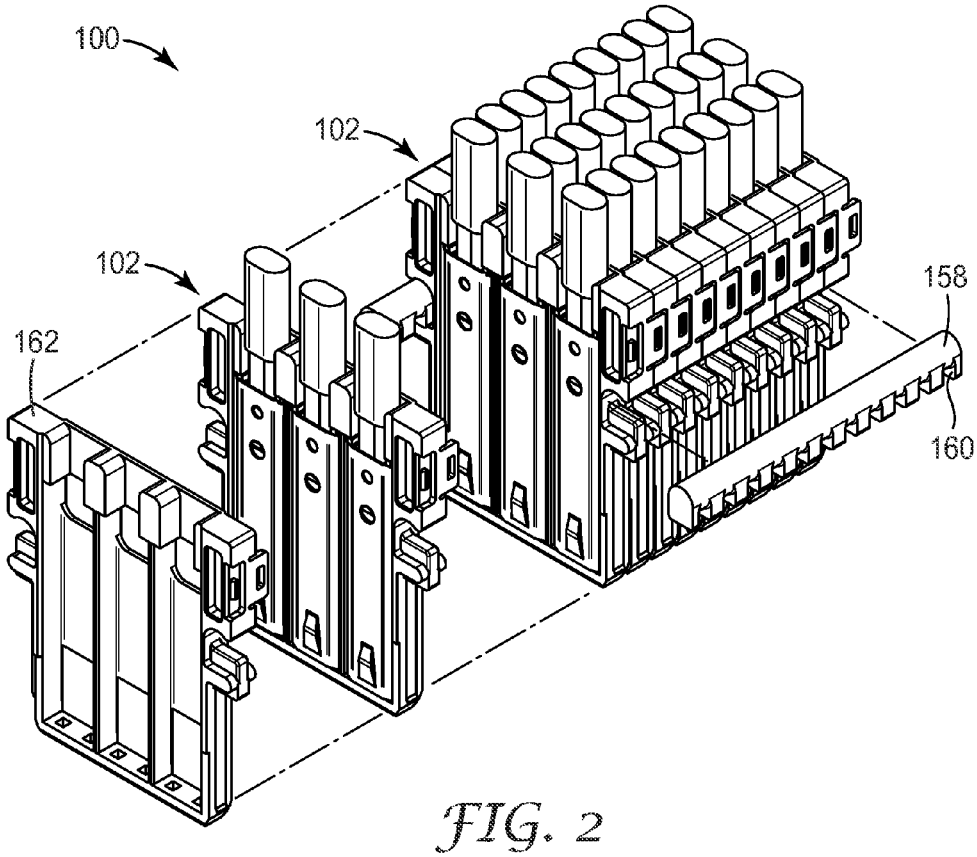
FIG. 2 is a partially exploded perspective view of an exemplary embodiment of a connector assembly according to an aspect of the present invention including a plurality of the electrical connectors of FIG. 1*a*.

In most applications, a plurality of electrical connectors 102 will be secured in a stacked configuration for use as an electrical connector assembly. An example of an electrical connector assembly including a plurality of electrical connectors 102 secured in a stacked configuration is illustrated in FIGS. 2 and 3. As seen in FIGS. 2 and 3, electrical connectors 102 are secured to each other by retention rod 158 to define electrical connector assembly 100. Retention rod 158 is adapted to engage a mating recess 154 on side edges 140 of connector body 106. Recesses 154 include a projecting rib 156 for engaging a mating groove 160 in retention rod 158. The grooves 160 are spaced along retention rod 158 such that when a plurality of electrical connectors 102 are stacked together and secured by retention rod 158, the electrical connectors 102 are held securely against one another. It is preferred that the material of retention rod 158 be somewhat resilient so that retention rod 158 may provide a compression force between the stacked electrical connectors 102. However, the material of retention rod 158 must also be rigid enough to maintain the stacked electrical connectors 102 in proper alignment in all other dimensions. Retention rod 158 is preferably formed of a polymeric material having a durometer less than the durometer of the material forming connector body 106. In this manner, retention rod 158 will yield to the material of connector body 106 as retention rod 158 engages connector body 106. Alternately, retention rod 158 may be formed of a material having a durometer greater than the durometer of the material forming connector body 106, such that the material of connector body 106 yields to the material of retention rod 158. Optionally, as illustrated in FIGS. 2 and 3, a spacer body 162 may be added to an end of the stack, e.g., to protect adjacent electrical connector 102 and its electrical cable terminations from contamination or damage. In other embodiments, spacer body 162 may take the place of one or more connector bodies 106 in electrical connector assembly 100 as is suitable for the intended application. Spacer body 162 is similar in design to connector body 106.

Figure 4A:
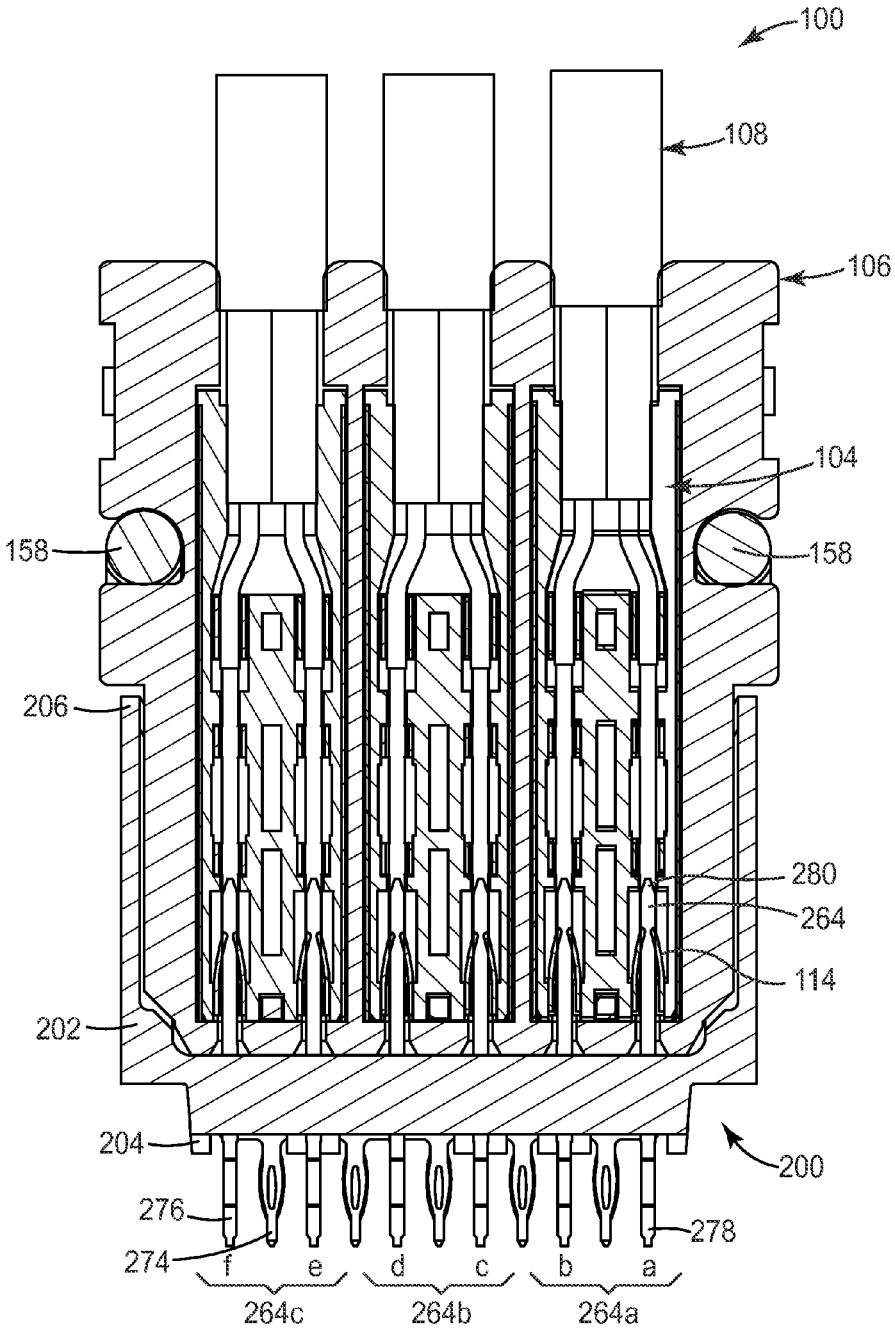
FIG. 4*a* is a partially cross-sectional view of the connector assembly of FIG. 2 mated with the corresponding header of FIG. 3.
Figure 4B:
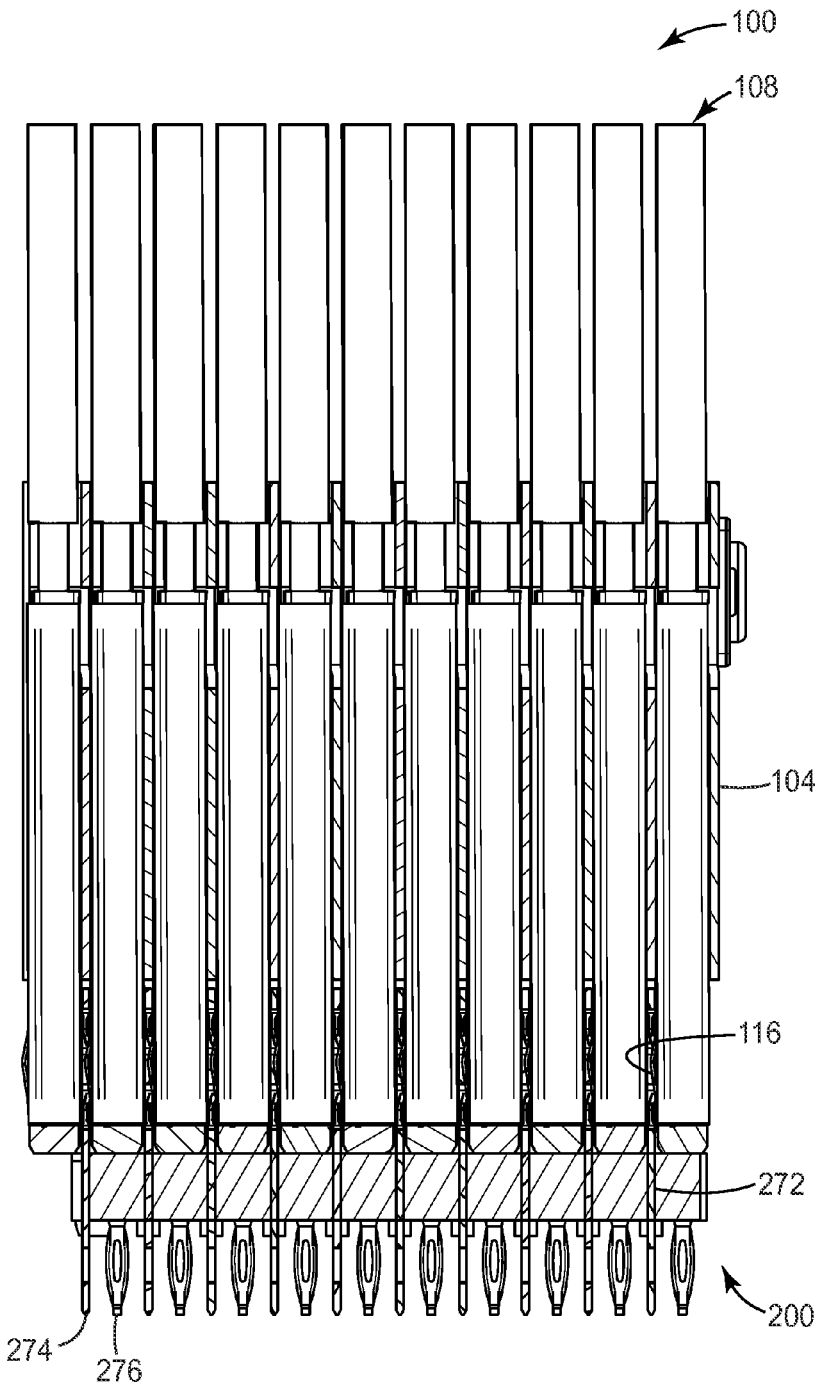
FIG. 4*b* is another partially cross-sectional view of the connector assembly of FIG. 2 mated with the corresponding header of FIG. 3.

A set of stacked electrical connectors 102 may be engaged with a header 200, as illustrated in FIGS. 3, 4*a* and 4*b*. It will be recognized by those skilled in the art that the configuration of retention rods 158 and recesses 154 may be altered to a variety of shapes while still performing their intended function. For example, rather than providing recess 154 in connector body 106 for receiving retention rod 158, a projection (not shown) could extend from connector body 106 and retention rod 158 could be adapted to engage the projection.

Connector body 106 may include at least one set of integrally formed retention elements 174 configured to retain adjacent electrical connectors 102 in a fixed relative position. In the illustrated embodiment, connector body 106 includes two sets of retention elements 174. A set of retention elements 174 is positioned on each side edge 140 near back edge 138 to retain adjacent electrical connectors 102 near back edge 138. The location of the sets of retention elements 174 may be selected depending upon the intended application. Each set of retention elements 174 may be configured to retain adjacent electrical connectors 102 in a fixed relative position by any suitable method, such as, e.g., snap fit, friction fit, press fit, and mechanical clamping. In the illustrated embodiment, each set of retention elements 174 includes a latch portion 174*a* and a corresponding catch portion 174*b* configured to retain adjacent electrical connectors 102 in a fixed relative position by snap fit.

Connector body 106 may include at least one set of integrally formed positioning elements 176 configured to position adjacent electrical connectors 102 with respect to each other. In the illustrated embodiment, connector body 106 includes two sets of positioning elements 176. A set of positioning elements 176 is positioned adjacent each side edge 140 near back edge 138. The location and configuration of the sets of positioning elements 176 may be selected depending upon the intended application. In the illustrated embodiment, each set of positioning elements 176 includes a positioning post 176*a* and a corresponding positioning recess 176*b* configured to position adjacent electrical connectors 102 with respect to each other.

The electrical connector 102 and stacking method described herein make it possible to interchange a single electrical connector 102 in a series of stacked electrical connectors without disconnecting the entire stack of electrical connectors from header 200 of a powered system. Commonly referred to as "hot swapping", this may be accomplished by simply removing the retention rods 158 from recesses 154 in the stacked electrical connectors and pulling a single electrical connector 102 from header 200. The removed electrical connector 102 may then be re-inserted after any necessary adjustment is made, or a new electrical connector may be installed in its place. The retention rods 158 are then reinstalled to secure the stack of electrical connectors. This is a significant advantage over conventional stackable electrical connectors which required that the entire stack of electrical connectors be removed from the header, and often further required that the entire stack of electrical connectors be disassembled so that a single electrical connector could be replaced.

To facilitate alignment of electrical connector 102 with the pin field of header 200, connector body 106 may be provided with an optional guide rail 166, which is useful for guiding the assembled electrical connector 102 into header 200. Guide rail 166 is adapted to mate with grooves 268 in header 200. The position and shape of guide rails 166 and grooves 268 may vary depending upon the particular use or application of electrical connector 102. Further, guide rails 166 may function as a connector polarization key to prevent an improper connection with header 200.

In one embodiment, header 200 is configured to electrically connect with a backplane of an electronic system or provide interconnection to a printed circuit board or other device. Suitable headers 200 include connection modules having paired signal pins or differential signal pin headers. In one embodiment, header 200 is a stripline header having contact pins 264 that are insertable into the backplane/board of a device and a plurality of stripline ground plates 272 spaced along a length of header 200. In one embodiment, contact pins 264 are paired differential signal pins and ground plates 272 are stripline ground plates, although other pin and plate structures are also acceptable. In another embodiment, contact pins 264 include single-ended signal pins.

Header 200 includes a housing 202 defining a leading end 204 and a mating end 206. Contact pins 264 project from leading end 204 for insertion into electronic devices, and mating end 206 receives electrical connector assembly 100. A separate set of compliant ground pins 274 extend into a core portion of header 200 and connect with stripline ground plates 272. In one embodiment, each stripline ground plate 272 includes stripline grounds 282 (or ground wipers 282) that are flexible and/or compliant and extend from a surface of stripline ground plate 272. In another embodiment, stripline ground plates 272 are planar and are not provided with ground wipers, and external ground contact 116 on electrical cable termination 104 provides ground contact with stripline ground plates 272.

In one embodiment, contact pins 264 are arranged in differential pairs 264*a*, 264*b* and 264*c* of signal pins (see FIG. 4*a*). Differential pairs 264*a*, 264*b* and 264*c* provide paired conducting paths, where the voltage difference between the conductive paths represents the signal through contact pins 264. In general, the two conducting paths of, e.g., differential pair 264*a* are arranged to run adjacent or near each other. In this manner, outside sources of electrical noise electromagnetically couples to the differential pair 264*a* resulting in a common noise voltage being coupled to both conducting paths in the differential pair 264*a*, which minimizes the undesirable interference affect on the signal through contact pin 264.

Each compliant ground pin 274 is connected to one of stripline ground plates 272 and extends from leading end 204 of housing 202. That is to say, each stripline ground plate 272 has one or more compliant ground pins 274 connected to stripline ground plate 272. Consequently, each stripline ground plate 272 is grounded, but all of stripline ground plates 272 are not commonly grounded to other stripline ground plates 272. In one embodiment, compliant ground pin 274 and stripline ground plate 272 are integrally formed, although any suitable electrical connection between stripline ground plate 272 and compliant ground pin 274 is acceptable.

Stripline ground plates 272 separate the rows of contact pins 264. Thus, compliant ground pins 274 alternate between compliant portions 276 of contact pins 264. Contact pins 264 include a first end 278 configured for insertion into electronic devices and a second end 280 that is configured to receive electrical cable termination 104.

Stripline grounds 282 compliantly extend from a planar surface 284 of stripline ground plate 272 by about 0.25 mm, although other suitable dimensions for stripline ground 282 are also acceptable. Header 200 is conventionally configured such that stripline ground 282 provides a ground path for one of stripline ground plates 272 and a connector coupled to one of contact pins 264. Thus, as best shown in FIG. 3, stripline ground plates 272 are not commonly grounded within header 200. In contrast, embodiments described herein provide electrical cable terminations 104 that electrically couple with contact pins 264 and commonly ground adjacent stripline ground plates 272 within header 200.

With the conventional header, an inserted connector makes contact with only one side of a stripline ground plate. In contrast with the known header, it has been surprisingly discovered that a significant improvement in electrical performance is achieved when electrical cable termination 104 contacts and commonly grounds two spaced apart stripline ground plates 272, such that each of the adjacent and spaced apart stripline ground plates 272 within header 200 is grounded/contacted by an electrical cable termination 104.

In one embodiment, header 200 is a 6×10 position vertical very high density metric (VHDM) header and electrical connector assembly 100 provides a 3×10 array of 2.25×2 mm twinaxial shielded controlled impedance (SCI) electrical cable terminations 104. The electrical connector system including header 200 and electrical connector assembly 100 provides fully shielded twinaxial signals and common grounding for all stripline ground plates 272 within header 200 in a manner that minimizes crosstalk between connections and improves signal integrity within header 200.

Referring to FIG. 4*a*, when electrical connector assembly 100 and header 200 are in a mated configuration, electrical contacts 114 of electrical cable terminations 104 make electrical contact with a corresponding contact pin 264 of header 200. In the illustrated embodiment, three electrical cable terminations 104 are arranged such as to form a signal-signal-signal-signal-signal-signal (SSSSSS) ordering when for each electrical cable termination 104, both electrical contacts 114 are designated as a signal contact. In this ordering, electrical contacts 114 make electrical contact with contact pins 264 positioned in rows a-f of header 200. These contact pins 264 are then designated as signal contact pins. This ordering in conjunction with the use of electrical cable terminations 104 makes it possible to obtain a significant increase in electrical performance (defined by characteristics such as, e.g., bandwidth and data rates) and density of electrical connector assembly 100 compared to conventional connector assemblies. Contributing to this increased electrical performance and density is the effectively 360° common ground matrix, provided by tubular housing 110 of electrical cable terminations 104 and stripline ground plates 272 of header 200, around the signal transmission paths, provided by electrical contacts 114 of electrical cable terminations 104 and contact pins 264 positioned in rows a-f of header 200. This embodiment provides an effectively shielded column-differential connector configuration. Alternatively, in the illustrated embodiment, three electrical cable terminations 104 are arranged such as to form a signal-ground-signal-ground-signal-ground (SGSGSG) ordering when, for each electrical cable termination 104, one electrical contact 114 is designated as a signal contact and the other electrical contact 114 is designated as a ground contact. In this ordering, electrical contacts 114 designated as a signal contact make electrical contact with contact pins 264 positioned in rows a, c, e of header 200. These contact pins 264 are then designated as signal contact pins. And, electrical contacts 114 designated as a ground contact make electrical contact with contact pins 264 positioned in rows b, d, f of header 200. These contact pins 264 are then designated as ground contact pins. This embodiment provides an effectively shielded single-ended connector configuration. It should be noted that embodiments are not limited to a particular number of rows of contact pins 264. The designation of electrical contacts 114 and corresponding contact pins 264 as signal, ground, or power contacts may be selected as suitable for the intended application.

Referring to FIG. 4*b*, when header 200 and electrical connector assembly 100 are in a mated configuration, external ground contacts 116 of electrical cable terminations 104 extend or project in a direction generally transverse to the linear arrangement of electrical contacts 114 such that at least two electrical cable terminations 104 make electrical contact with a common stripline ground plate 272 to further contribute to the effectively 360° common ground matrix described above. In other embodiments of electrical connector assembly 100, individual external ground contacts 116 may be eliminated as is suitable for the intended application.

The electrical connectors and electrical connector assemblies as described above provide numerous advantages compared to conventional connectors and connector assemblies. The flexibility in the configuration of external ground contacts allows complete flexibility as to the arrangement of electrical cable terminations in the electrical connector assembly and corresponding contact pins in the header, while maintaining an effectively 360° common ground matrix around the electrical signal transmission paths. This ground matrix contributes to a significant increase in electrical performance (defined by characteristics such as, e.g., bandwidth and data rates) and density of the electrical connector assembly compared to conventional connector assemblies, and may provide controlled electrical impedance for an electrical connector system including a header and electrical connector assembly as described herein to accommodate circuit switching speed in the 3-5 GHz range or above. While maintaining the external profile of the connector body, the flexibility in the configuration of the channels of the connector body allows complete flexibility as to the configuration and arrangement of electrical cable terminations and external electrical contacts in the connector body as is suitable for the intended application in a cost-effective manner. For example, transmission of high speed signals may be provided by the electrical contacts of the electrical cable terminations, while transmission of low speed signals or power may be provided by the external electrical contacts. Individual electrical cable terminations and external electrical contacts can be manufactured as a complete cable assembly, verified, and tested prior to assembly into a connector body. They can also be individually removed from the connector body for repair or replacement, for example. Maintaining the external profile of the connector body allows any number of electrical connectors to be stacked without extra components, while allowing the stack of electrical connectors to be easily disassembled and further allowing "hot swapping" of a single electrical connector in a stack of electrical connectors.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In one embodiment, electrically insulative components, such as, e.g., connector body 106 and inner housing 112, are formed of a polymeric material by methods such as injection molding, extrusion, casting, machining, and the like, while electrically conductive components, such as, e.g., electrical contacts 114, external ground contacts 116, and contact pins 264, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Following are exemplary embodiments of an electrical connector system according to aspects of the present invention.

Embodiment 1 is an electrical connector system comprising: a header comprising a leading end having a plurality of contact pins that are insertable into an electronic device and a plurality of separated stripline ground plates extending from the leading end toward a mating end of the header; and an electrical connector assembly coupleable with the mating end of the header, the electrical connector assembly comprising a plurality of electrical connectors secured in a stacked configuration, each electrical connector including: a plurality of electrical cable terminations for mating with a corresponding plurality of contact pins of the header, each electrical cable termination comprising: a tubular housing of electrically conductive material having inner walls defining an opening and first and second opposed open ends; an inner housing of electrically insulating material inserted into the tubular housing from at least one of the open ends thereof, the inner housing comprising at least one inner space configured to receive an electrical contact in a fixed relative position; and at least one electrical contact positioned in the inner housing and configured to be connected to an electrical cable; and a planar insulative connector body having an upper surface and an opposing lower surface, the upper and lower surfaces defined by a front edge, a back edge, and two longitudinal side edges, the upper surface including a plurality of longitudinal channels, each channel containing one of the plurality of electrical cable terminations, the front edge of the connector body having a plurality of openings for guiding the contact pins into the mating electrical cable terminations positioned within the channels, wherein at least two electrical cable terminations make electrical contact with a common stripline ground plate when the header and the electrical connector assembly are in a mated configuration.

Embodiment 2 is the electrical connector system of embodiment 1, wherein at least one electrical cable termination further comprises at least one external ground contact extending from the tubular housing and configured to compliantly contact a stripline ground plate.

Embodiment 3 is the electrical connector system of embodiment 1, wherein at least one electrical cable termination is electrically isolated from a common stripline ground plate when the header and the electrical connector assembly are in a mated configuration.

Embodiment 4 is the electrical connector system of embodiment 1, wherein the tubular housing of at least one electrical cable termination commonly grounds adjacent stripline ground plates when the header and the electrical connector assembly are in a mated configuration.

Embodiment 5 is the electrical connector system of embodiment 1, wherein the tubular housing of each electrical cable termination fully shields a corresponding contact pin when the header and the electrical connector assembly are in a mated configuration.

Embodiment 6 is the electrical connector system of embodiment 1, wherein each electrical cable termination comprises a coaxial cable termination comprising a signal contact positioned in the inner housing and configured to be connected to a coaxial cable, and wherein when the header and the electrical connector assembly are in a mated configuration, the signal contact makes electrical contact with a corresponding contact pin and the tubular housing fully shields the signal contact and corresponding contact pin and commonly grounds adjacent stripline ground plates.

Embodiment 7 is the electrical connector system of embodiment 1, wherein each electrical cable termination comprises a twinaxial cable termination comprising two signal contacts positioned in the inner housing and configured to be connected to a twinaxial cable, and wherein when the header and the electrical connector assembly are in a mated configuration, the two signal contacts make electrical contact with corresponding contact pins and the tubular housing fully shields the two signal contacts and corresponding contact pins and commonly grounds adjacent stripline ground plates.

Embodiment 8 is the electrical connector system of embodiment 1, wherein each connector body includes an integrally formed engagement surface on at least one of its longitudinal edges, and wherein the electrical connector assembly includes a retention rod configured to securely engage each engagement surface such that the plurality of electrical connectors are secured in a stacked configuration.

Embodiment 9 is the electrical connector system of embodiment 1, wherein each connector body includes at least one set of integrally formed retention elements configured to retain adjacent electrical connectors in a fixed relative position.

Embodiment 10 is the electrical connector system of embodiment 1, wherein each electrical cable termination is individually removable from the connector body.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector system comprising:

a header comprising a leading end having a plurality of contact pins that are insertable into an electronic device and a plurality of separated stripline ground plates extending from the leading end toward a mating end of the header; and an electrical connector assembly coupleable with the mating end of the header, the electrical connector assembly comprising a plurality of electrical connectors secured in a stacked configuration, each electrical connector including:

a plurality of electrical cable terminations for mating with a corresponding plurality of contact pins of the header, each electrical cable termination comprising:

a tubular housing of electrically conductive material having inner walls defining an opening and first and second opposed open ends;

an inner housing of electrically insulating material inserted into the tubular housing from at least one of the open ends thereof, the inner housing comprising at least one inner space configured to receive an electrical contact in a fixed relative position; and at least one electrical contact positioned in the inner housing and configured to be connected to an electrical cable; and a planar insulative connector body having an upper surface and an opposing lower surface, the upper and lower surfaces defined by a front edge, a back edge, and two longitudinal side edges, the upper surface including a plurality of longitudinal channels, each channel containing one of the plurality of electrical cable terminations, the front edge of the connector body having a plurality of openings for guiding the contact pins into the mating electrical cable terminations positioned within the channels, wherein at least two electrical cable terminations make electrical contact with a common stripline ground plate when the header and the electrical connector assembly are in a mated configuration.

2. The electrical connector system of claim 1, wherein at least one electrical cable termination further comprises at least one external ground contact extending from the tubular housing and configured to compliantly contact a stripline ground plate.

3. The electrical connector system of claim 1, wherein at least one electrical cable termination is electrically isolated from a common stripline ground plate when the header and the electrical connector assembly are in a mated configuration.

4. The electrical connector system of claim 1, wherein the tubular housing of at least one electrical cable termination commonly grounds adjacent stripline ground plates when the header and the electrical connector assembly are in a mated configuration.

5. The electrical connector system of claim 1, wherein the tubular housing of each electrical cable termination fully shields a corresponding contact pin when the header and the electrical connector assembly are in a mated configuration.

6. The electrical connector system of claim 1, wherein each electrical cable termination comprises a coaxial cable termination comprising a signal contact positioned in the inner housing and configured to be connected to a coaxial cable, and wherein when the header and the electrical connector assembly are in a mated configuration, the signal contact makes electrical contact with a corresponding contact pin and the tubular housing fully shields the signal contact and corresponding contact pin and commonly grounds adjacent stripline ground plates.

7. The electrical connector system of claim 1, wherein each electrical cable termination comprises a twinaxial cable termination comprising two signal contacts positioned in the inner housing and configured to be connected to a twinaxial cable, and wherein when the header and the electrical connector assembly are in a mated configuration, the two signal contacts make electrical contact with corresponding contact pins and the tubular housing fully shields the two signal contacts and corresponding contact pins and commonly grounds adjacent stripline ground plates.

8. The electrical connector system of claim 1, wherein each connector body includes an integrally formed engagement surface on at least one of its longitudinal edges, and wherein the electrical connector assembly includes a retention rod configured to securely engage each engagement surface such that the plurality of electrical connectors are secured in a stacked configuration.

9. The electrical connector system of claim 1, wherein each connector body includes at least one set of integrally formed retention elements configured to retain adjacent electrical connectors in a fixed relative position.

10. The electrical connector system of claim 1, wherein each electrical cable termination is individually removable from the connector body.

* * * * *